US005667011A

United States Patent [19]

Gill et al.

[11] Patent Number: 5,667,011

[45] Date of Patent: Sep. 16, 1997

[54] METHOD OF CREATING A CASING IN A BOREHOLE

[75] Inventors: Daljit Singh Gill; Wilhelmus Christianus Maria Lohbeck; Robert Bruce Stewart; Jacobus Petrus Maria Van Vliet, all of Rijswijk, Netherlands

[73] Assignee: Shell Oil Company, Houston, Tex.

[21] Appl. No.: 599,427

[22] Filed: Jan. 16, 1996

[30] Foreign Application Priority Data

Jan. 16, 1995 [EP] European Pat. Off. ..... 95200099

[51] Int. Cl.[6] ..... E21B 29/08; E21B 33/14

[52] U.S. Cl. ..... 166/295; 166/207; 166/242.1; 166/285; 166/292; 166/296

[58] Field of Search ..... 166/207, 242.1, 166/277, 285, 287, 292, 295, 296, 376, 380

[56] References Cited

U.S. PATENT DOCUMENTS

| | | | |
|---|---|---|---|
| 2,207,478 | 7/1940 | Cameron, Sr. . | |
| 2,447,629 | 8/1948 | Beissinger et al. | 166/207 |
| 3,052,298 | 9/1962 | Malott . | |
| 3,175,618 | 3/1965 | Lang et al. . | |
| 3,203,451 | 8/1965 | Vincent | 166/277 X |
| 3,958,637 | 5/1976 | Cobbs | 166/287 |
| 4,495,997 | 1/1985 | Scott et al. | 166/285 |
| 4,501,327 | 2/1985 | Retz | 166/277 |
| 4,716,965 | 1/1988 | Bol et al. | 166/292 |
| 5,240,074 | 8/1993 | Peavy et al. | 166/286 |
| 5,348,095 | 9/1994 | Worrall et al. | 166/380 |
| 5,366,012 | 11/1994 | Lohbeck | 166/277 |

*Primary Examiner*—George A. Suchfield

[57] ABSTRACT

The invention relates to a method of creating a casing in a borehole formed in an underground formation. The method comprises the steps of (a) installing a tubular liner in the borehole, the liner being radially expandable in the borehole whereby the liner in its radially expanded position has a plurality of openings which are overlapping in the longitudinal direction of the liner, (b) radially expanding the liner in the borehole, and (c) either before or after step (b), installing a body of hardenable fluidic sealing material in the borehole so that the sealing material fills said openings and thereby substantially closes said openings. The sealing material is selected so as to harden in said openings and thereby to increase the compressive strength of the liner.

13 Claims, 1 Drawing Sheet

METHOD OF CREATING A CASING IN A BOREHOLE

FIELD OF THE INVENTION

The invention relates to a method of creating a casing in a borehole formed in an underground formation, the borehole being for example a wellbore for the production of oil, gas or water.

BACKGROUND TO THE INVENTION

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping and cement hardening.

International patent application WO 93/25799 discloses a method of creating a casing in a section of a borehole formed in an underground formation, wherein a tubular element in the form of a casing is installed within the section of the borehole, and radially expanded using an expansion mandrel. Expansion of the casing continues until the casing contacts the borehole wall and elastically deforms the surrounding rock formation. Optionally, when washouts occur in the borehole wall during drilling, or when brittle formations are encountered during drilling, cement is pumped in an annular space around the casing at the location of such washout or brittle formation.

Although the known method overcomes the problem of conventional casings whereby the diameter of subsequent casing sections decreases in downward direction, there remains a need for a method of creating a casing in a borehole, whereby a lower load is required to expand the tubular element, and whereby an improved sealing between the casing and the surrounding earth formation is achieved.

In WO 93/25800 an application of a production liner in a borehole is disclosed, the production liner provided with longitudinally overlapping openings and is radially expanded in the borehole. The production liner serves as a strainer during production of hydrocarbon fluid flowing from the surrounding earth formation through the openings, into the liner. It is essential for this production liner that fluid communication is maintained between the interior of the liner and the surrounding earth formation, i.e. it is essential that the occurrence of a sealing between the production liner and the surrounding formation is avoided. This is contrary to the object of the present invention which is aimed at providing an improved sealing between the casing and the surrounding earth formation. It is another object of the invention to provide a method of creating a casing having an improved collapse resistance. A further object of the invention is to provide a method of creating a casing which allows a smaller difference in borehole diameter between an upper interval and a lower interval of the borehole.

SUMMARY OF THE INVENTION

In accordance with the invention there is provided a method of creating a casing in a borehole formed in an underground formation, the method comprising the steps of:

(a) installing a tubular liner in the borehole, the liner being radially expandable in the borehole whereby the liner during its radial expansion has a plurality of openings which are overlapping in the longitudinal direction of the liner;

(b) radially expanding the liner in the borehole; and (c) either before or after step (b), installing a body of hardenable fluidic sealing material in the borehole so that the sealing material fills said openings and thereby substantially closes said openings, the sealing material being selected so as to harden in said openings and thereby increasing the compressive strength of the liner.

Thus the method of the invention allows application of casing sections of uniform diameter so that a nested arrangement of subsequent casing sections as in conventional casing schemes can be avoided. With the method of the invention a reliable sealing between the liner and the borehole wall is achieved while the openings of the liner allow a large radial expansion of the liner. After hardening of the sealing material, the liner with the openings filled with sealing material forms a continuous reinforced wellbore casing. The liner is suitably made of steel, and can be provided for example in the form of jointed liner sections or reeled.

Furthermore a significantly lower radial force is required to expand the liner than the force required to expand the solid casing of the known method.

An additional advantage of the method of the invention is that the liner after expansion thereof has a larger final diameter than the diameter of an expansion tool which is applied. The difference between the permanent final diameter and the largest diameter of the expansion tool is referred to as permanent surplus expansion.

Suitably the body of sealing material is installed in the borehole after radially expanding the liner.

Additional strength of the liner is achieved by providing the body of sealing material with reinforcing fibres.

In case a part of said body of sealing material remains in the interior of the liner, said part is suitably removed from said interior after expansion of the liner, for example by drilling away said part of the body of sealing material after the sealing material has hardened.

The liner can be radially expanded until it contacts the borehole wall, or alternatively until an annular space between the liner and the borehole wall remains whereby the body of hardenable fluidic sealing material extends into said annular space.

DETAILED DESCRIPTION OF THE PREFERRED EMBODMENT

Figure 1:
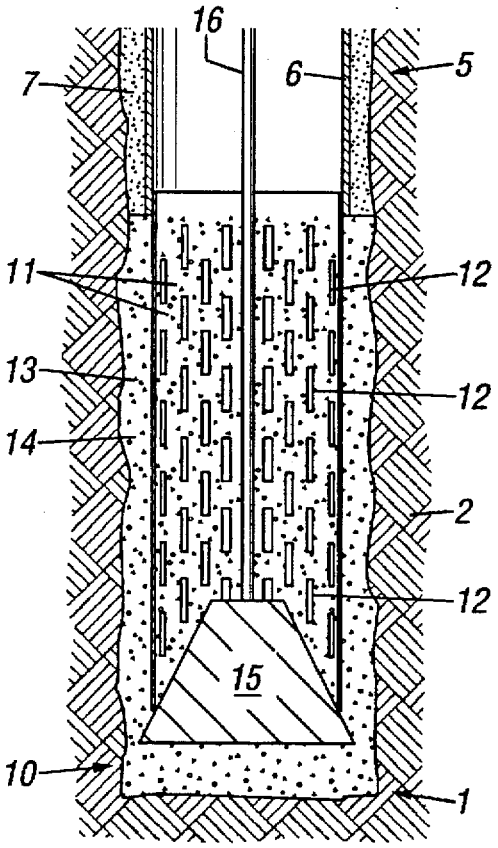
FIG. 1 shows schematically a longitudinal cross-section of a borehole having an uncased section that has to be provided with a casing including a liner provided with longitudinally overlapping openings.

Referring now to FIG. 1, the lower part of a borehole 1 is shown, the borehole drilled in an underground formation 2.

The borehole 1 has a cased section 5, wherein the borehole 1 is provided with a casing 6 secured to the wall of the borehole 1 by means of a layer of cement 7, and an uncased section 10.

In the uncased section 10 of borehole 1 a steel liner 11 provided with longitudinally overlapping openings has been lowered to a selected position, in this case the end of the casing 6. The openings of the liner have been provided in the form of longitudinal slots 12, so that the liner 11 forms a slotted liner with overlapping longitudinal slots 12. For the sake of clarity not all slots 12 have been provided with a reference numeral. The upper end of the slotted liner 11 has been fixed to the lower end of the casing 6 by means of a suitable connecting means (not shown).

In a next step, a hardenable sealing material in the form of cement mixed with fibers (not shown) is inserted into the slotted liner 11. The cement forms a body of cement 13 in the borehole 1, whereby part of the cement flows through the slots 12 of the liner 11 and around the lower end of the slotted liner 11 into an annular space 14 between the slotted liner 11 and the wall of the borehole 1, and another part of the cement remains in the interior of the slotted liner 11.

Having inserted the cement in the borehole 1, the slotted liner 11 is expanded using an expansion mandrel 15. The slotted liner 11 has been lowered at the lower end of string 16 resting on the expansion mandrel 15. To expand the slotted liner 11 the expansion mandrel 15 is moved upwardly through the slotted liner 11 by pulling on string 16. The expansion mandrel 15 is tapered in the direction in which the mandrel 15 is moved through the slotted liner 11, in this case the expansion mandrel 15 is an upwardly tapering expansion mandrel. The expansion mandrel 15 has a largest diameter which is larger than the inner diameter of the slotted liner 11.

Figure 2:
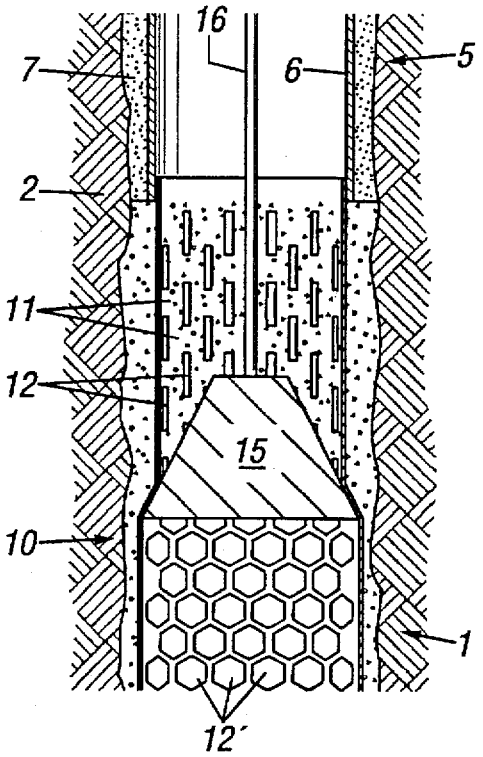
FIG. 2 shows part of FIG. 1, wherein a part of the liner has been expanded.

Referring now to FIG. 2, the slotted liner 11 is shown in partly expanded form, wherein the lower part of the slotted liner has been expanded. The same features as shown in FIG. 1 have the same reference numerals. The slots deform to openings designated with reference numeral 12'. As the expansion mandrel 15 moves through the slotted liner 11, cement present in the interior of the slotted liner 11 is squeezed by the expansion mandrel 15 through the slots 12 into the annular space 14. Since furthermore the annular space 14 becomes smaller due to the expansion of the liner 11, the cement is squeezed against the wall of the borehole 1, and the expanded liner 11 becomes adequately embedded in the cement.

After the slotted liner 11 has been radially expanded to its full length, the cement of the body of cement 13 is allowed to harden so that a steel reinforced cement casing is achieved, whereby the fibers provide additional reinforcement to the casing. Any part of the body of hardened cement 13 which may remain in the interior of the slotted liner 11 can be removed therefrom by lowering a drill string (not shown) into the slotted liner 11 and drilling away such part of the body of cement 13. The steel reinforced casing thus obtained prevents collapse of the rock formation surrounding the borehole 1 and protects the rock formation from fracturing due to high wellbore pressures which may occur during drilling further (deeper) borehole sections. A further advantage of the steel reinforced cement casing is that the steel liner protects the cement from wear during drilling of such further borehole sections.

Instead of moving the expansion mandrel upwardly through the liner, the expansion mandrel can alternatively be moved downwardly through the liner during expansion thereof. In a further alternative embodiment, a contractible and expandable mandrel is applied. First the liner is lowered in the borehole and subsequently fixed, whereafter the expansion mandrel in contracted form is lowered through the liner. The expansion mandrel is then expanded and pulled upwardly so as to expand the liner.

The method according to the invention can be applied in a vertical borehole section, a deviated borehole section, or in a horizontal borehole section.

Instead of applying the tapered expansion mandrel described above, an expansion mandrel provided with rollers can be applied, which rollers are capable of rolling along the inner surface of the liner when the mandrel is rotated, whereby the mandrel is simultaneously rotated and axially moved through the liner.

In a further alternative embodiment, the expansion mandrel forms a hydraulic expansion tool which is radially inflated upon provision of a selected fluid pressure to the tool, and whereby step (b) of the method according to the invention comprises providing said selected pressure to the tool.

Any suitable hardenable sealing material can be applied to form the body of sealing material, for example cement, such as conventionally used Portland cement or blast furnace slag cement, or a resin such as an epoxy resin. Also any suitable resin which cures upon contact with a curing agent can be used, for example by providing the liner internally or externally with a first layer of resin and a second layer of curing agent whereby during expansion of the liner the two layers are squeezed into the openings of the liner and become intermixed so that the curing agent induces the resin to cure.

The sealing material can be inserted into the annular space between the liner and the borehole wall by circulating the sealing material through the liner, around the lower end of the slotted liner, and into the annular space. Alternatively the sealing material can be circulated in the reverse direction, i.e. through the annular space, around the lower end of the liner, and into the liner.

In the foregoing description the liner is provided with a plurality of slots, whereby during radial expansion of the liner the slot widens so as to form the openings. If it is required to pump fluid through the liner before radial expansion thereof, the slos can be sealed before such radial expansion of the liner takes place, for example by means of polyurethane sealing material.

In an alternative embodiment the liner is provided with a plurality of sections of reduced wall-thickness, whereby during radial expansion of the liner each section of reduced wall-thickness shears so as to form one of the openings. For example, each section of reduced wall-thickness can be in the form of a groove provided in the wall of the liner. Preferably each groove extends in the longitudinal direction of the liner.

We claim:

1. A method of creating a casing in a borehole formed in an underground formation, the method comprising the steps of:

(a) installing a tubular liner in the borehole, the liner being radially expandable in the borehole whereby the liner during its radial expansion has a plurality of openings which are overlapping in the longitudinal direction of the liner;

(b) radially expanding the liner in the borehole; and (c) either before or after step (b), installing a body of hardenable fluidic sealing material in the borehole so that the sealing material fills said openings and thereby substantially closes said openings, the sealing material being selected so as to harden in said openings and thereby increasing the compressive strength of the liner.

2. The method of claim 1, wherein the body of sealing material is installed in the borehole after radially expanding the liner.

3. The method of claim 1 wherein the body of sealing material is provided with reinforcing fibres which reinforce the sealing material after hardening thereof.

4. The method of claim 1 wherein the liner is radially expanded using an expansion mandrel having a largest diameter larger than the inner diameter of the liner before expansion thereof, whereby the mandrel is axially moved through the liner.

5. The method of claim 1 wherein the hardenable sealing material is selected from the group of cement, Portland cement, blast furnace slag cement, resin, epoxy resin and resin which cures upon contact with a curing agent.

6. The method of claim 1 wherein the liner is provided with a plurality of sections of reduced wall-thickness, whereby during radial expansion of the liner each section of reduced wall-thickness shears so as to form one of said openings.

7. The method of claim 6 wherein each section of reduced wall-thickness forms a groove provided in the wall of the liner.

8. The method of claim 7, wherein each groove extends in the longitudinal direction of the liner.

9. The method of claim 1 wherein the liner is provided with a plurality of slots, whereby during radial expansion of the liner each slot widens so as to form one of said openings.

10. The method of claim 9 wherein said slots extend in longitudinal direction of the liner.

11. The method of claim 9 wherein before radial expansion of the liner the slots are sealed so as to allow fluid to be induced to flow through the liner.

12. The method of claim 11 wherein the slots are sealed by polyurethane sealing material.

13. The method of claim 1 wherein after radially expanding the liner in the borehole an annular space remains between the liner and the borehole wall, whereby the body of hardenable fluidic sealing material extends into said annular space.

* * * * *